United States Patent [19]

Haab et al.

[11] Patent Number: 4,945,605

[45] Date of Patent: Aug. 7, 1990

[54] FITTING FOR SLIDING DOORS SUSPENDED AT A RUNWAY RAIL

[75] Inventors: Karl Haab, Rotkreuz; Otto Haab, Mettmenstetten, both of Switzerland

[73] Assignee: Hawa AG, Mettmenstetten, Switzerland

[21] Appl. No.: 314,082

[22] Filed: Feb. 23, 1989

[30] Foreign Application Priority Data

Mar. 4, 1988 [CH] Switzerland ..... 828/88

[51] Int. Cl.[5] ..... E05D 15/00

[52] U.S. Cl. ..... 16/97; 16/87 R

[58] Field of Search ..... 16/87 R, 87.2, 97

[56] References Cited

U.S. PATENT DOCUMENTS 1,832,050 11/1931 Pitcher ..... 16/87 R 2,207,322 7/1940 Long ..... 16/87 R

FOREIGN PATENT DOCUMENTS 740746 10/1943 Fed. Rep. of Germany ..... 16/97

*Primary Examiner*—Richard K. Seidel

*Assistant Examiner*—Carmine Cuda

*Attorney, Agent, or Firm*—Laurence R. Brown

[57] ABSTRACT

The fitting for sliding doors includes a longitudinal groove extending in its mounted state in the longitudinal direction of the upper edge of the door which groove has two upper flanges covering the groove only partly. This allows a mounting of a sliding door and a hooking thereof onto a runway rail without the need of a lateral clearance.

9 Claims, 2 Drawing Sheets

FITTING FOR SLIDING DOORS SUSPENDED AT A RUNWAY RAIL

BACKGROUND OF THE INVENTION

1. Field of the Invention

The present invention relates to a fitting for sliding doors suspended at a runway rail, which fitting is intended for a mounting to the upper edge of the sliding door or to a travelling or sliding carriage associated therewith or is structured as an integrated component of the latter and serves for the mounting to a counter fitting at the travelling or sliding carriage or to the upper edge of the door and is, therefore, provided with a recess having an opening facing the counter fitting in its mounted condition thereof and intended for receipt and positioning of the head of a mounting member forming part of the counter fitting, which recess is accessible from its side via a groove having two upper side flanges covering partly the groove.

2. Description of the Prior Art

Such fittings are generally of the same design. The mounting element has to be inserted into the fitting mounted on the door laterally relative to the upper edge of the sliding door. For this reason the sliding doors necessitate for their mounting or possible removing a lateral insertion path of about 10 to 20 millimeters. This means, however, that front blinds for the hiding of the mechanism of the sliding door must either be mounted at a corresponding distance from the runway rail or sliding door, which influences the aesthetics detrimentally and is a waste of space, or then must be designed such that they may be removed.

Specifically in the case of a sliding door separating rooms these drawbacks are of severe consequences. Laterally located covering walls can be mounted only after the sliding door has been hung onto its rail. Such covering walls are often mounted to kitchen furniture sets, to mounted furniture and similar, such that the sliding doors, e.g. in case of a possible repairing at the fitting of the door, can be dismounted only at large expenditures.

A further severe drawback of the known design of fittings is that upon the tightening of the counter nut of the mounting element at the fitting of the door such is rotated along and moves in the receiving groove extending laterally relative to the upper edge of the door, such that the set level as well as the lateral position of the sliding door are changed and must be readjusted several times. This task ends often in a time consuming trying procedure.

SUMMARY OF THE INVENTION

It is, therefore, a general object of the invention to provide a fitting for such sliding doors avoiding the above mentioned drawbacks. According to the invention this problem is solved by a fitting having a longitudinal groove extending in its mounted condition in the longitudinal direction of the upper edge of the sliding door and extending into said recess.

In order to also provide for the possibility of lateral adjustment an additional lateral groove is provided which extends through the longitudinal groove. Accordingly, also in case of a mounted lateral covering wall the sliding door can easily be hooked into the mounting member without necessitating a larger lateral intervening space. It is also possible to fixedly mount an upper front covering until immediately adjacent the sliding door, which specifically in case of doors of cabinets leads to an optical improvement which is not to be underestimated. Additionally, due to this preferred construction the universality of the fitting is improved.

In order to prevent a shifting of the set position of the sliding door during the mounting of the mounting element to the fitting, a recess having parallel edges is preferably located at the lower side of the side flanges and extending in the longitudinal direction of the groove, such to cause a substantially form-locked positioning of a correspondingly shaped head of the mounting member. By means of such, a rotating or a shifting of the mounting member during the tightening of a counter nut will be prevented.

BRIEF DESCRIPTION OF THE DRAWINGS

The invention will be better understood and objects other than those set forth will become apparent when consideration is given to the following detailed description thereof. Such description makes reference to the annexed drawings wherein.

DETAILED DESCRIPTION OF THE PREFERRED EMBODIMENT

Figure 1:
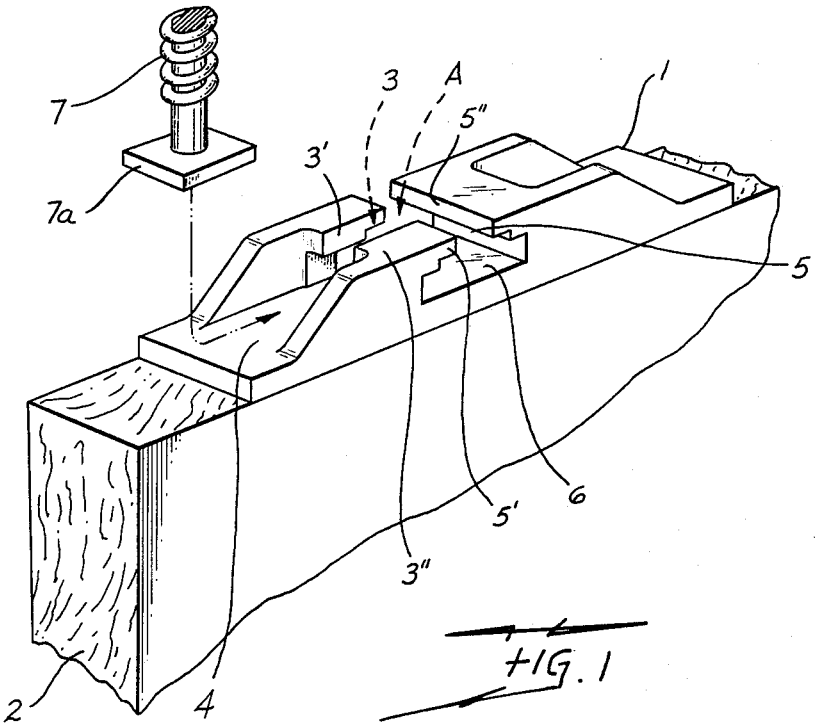
FIG. 1 is a perspective view of a fitting in accordance with the invention, including the head area of the mounting element.
Figure 2:
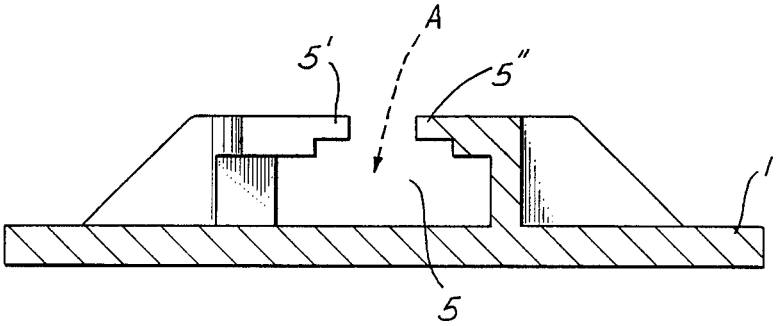
FIG. 2 is a section through the longitudinal center plane of the fitting of FIG. 1.
Figure 3:
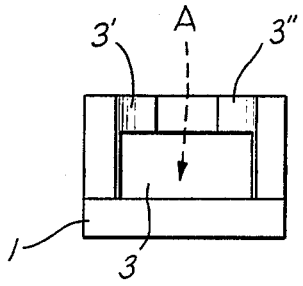
FIG. 3 is a view from the left onto the fitting of FIG. 1.

The fitting 1 illustrated in the figures is screwed onto the upper edge of a sliding door 2. The head *7a* of a mounting member 7 connected to a travelling carriage is guided into an opening 4 of the fitting 1 and slid into the longitudinal groove 3. To this end merely an upwards movement and a longitudinal shifting of the door 2 or of mounting member 7 is necessary. The mounting member 7 is positioned at the rear abutment of the longitudinal groove 3 or by abutting the side flanges 5' and 5'' of the lateral groove 5, respectively. Due to the lateral groove 5 a lateral positioning of the mounting member is possible. If the head *7a* of the mounting member 7 is designed such to have two parallel edges, a rising or lifting of the head leads to a substantially form-locked receipt between the abutment edges 6 of an additional recess in the lateral groove 5. By means of such only a lateral shifting of the coupling member 7 for an adjusting thereof is possible, a rotating or twisting of this mounting member is, however, prevented. A preventing of the tendency of the mounting element 7 to shift sideways during a tightening of a counter nut is prevented as well and the selected adjustment will be maintained.

Figure 4:
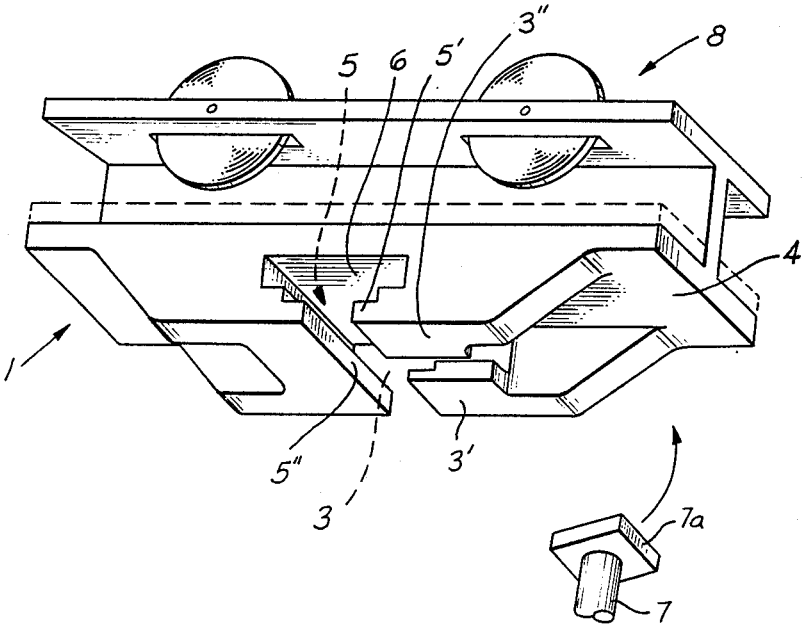
FIG. 4 is a perspective view of a fitting in accordance with the invention mounted to a travelling carriage.

Basically, it is also conceivable to design the fitting 1 as part (integral part or part mounted thereto) of the travelling or sliding carriage 8 and to mount the counter fitting, i.e. the mounting element 7 having a head *7a*, onto the upper edge of the door (not specifically illustrated). Also such a fitting allows a simple and precise mounting of the sliding door. Such a design is illustrated schematically in FIG. 4.

While there are shown and described present preferred embodiments of the invention, it is to be distinctly understood that the invention is not limited thereto, but may be otherwise variously embodied and practiced within the scope of the following claims.

We claim:

1. A fitting for sliding doors suspended at a runway rail, which fitting is intended for a mounting to the upper edge of the sliding door and serves for the mounting to an associated travelling or sliding carriage, said fitting comprising: an elongate body adapted for mounting to an edge of a slidable door, the body including a longitudinal recess for the receipt and positioning there within of the head of a mounting member attached to said travelling or sliding carriage, a transverse recess intersecting the longitudinal recess and having two spaced upper side flanges partly overlaying the transverse recess and defining a transverse groove which extends across the entire width of the body, a longitudinal groove extending upwardly from the longitudinal recess and having a smaller width than that of the longitudinal recess to slidably receive the associated carriage.

2. The fitting of claim 1, wherein the transverse recess extends through said longitudinal recess and is shaped correspondingly for the lateral positioning of the associated carriage.

3. The fitting of claim 2, wherein each of the longitudinal and transverse recesses has a width greater than that of the corresponding longitudinal and transverse grooves to receive a correspondingly shaped part of the head of said mounting member in a substantially form locked fashion and to lock said head against any rotation.

4. A fitting for sliding doors suspended at a runway rail, which fitting is intended for a mounting to a travelling or sliding carriage associated therewith and serves for the mounting to a counter fitting at the upper edge of the door, said fitting comprising: an elongate body adapted for mounting to an edge of a door, a longitudinal recess in the body, the recess having an upwardly open longitudinal groove facing the counter fitting in its mounted condition thereof and intended for receipt and positioning of the head of a mounting member forming part of the counter fitting, a transverse recess in the body, the transverse recess intersecting the longitudinal recess and having two spaced upper side flanges partially covering the transverse recess and defining an upwardly open transverse groove which extends across the entire width of the body between the spaced side flanges, the longitudinal groove extending in the longitudinal direction of the upper edge of the sliding door and extending into the recess to permit longitudinal movement of the mounting member along the longitudinal recess.

5. The fitting of claim 4, wherein the transverse recess extends through said longitudinal recess and is shaped correspondingly, the transverse groove having openings adjacent a front face and adjacent a rear face of the door for the lateral positioning of said mounting member.

6. The fitting of claim 4, wherein each of the longitudinal and transverse recesses has a width greater than that of the corresponding longitudinal and transverse grooves to receive a correspondingly shaped part of the head of said mounting member in a substantially form locked fashion and to lock said head against any rotation.

7. A fitting for sliding doors suspended at a runway rail, which fitting is structured as an integral component of an associated travelling of sliding carriage and serves for the mounting to a counter fitting at the upper edge of the door, said fitting comprising: an elongate body adapted for mounting to an edge of a door, a longitudinal recess in the body, the recess having an upwardly open longitudinal groove facing the counter fitting in its mounted condition thereof and intended for receipt and positioning of the head of a mounting member forming part of the counter fitting, a transverse recess in the body, the transverse recess intersecting the longitudinal recess and having two spaced upper side flanges partially covering the transverse recess and defining an upwardly open transverse groove which extends across the entire width of the body between the spaced side flanges, the longitudinal groove extending in the longitudinal direction of the upper edge of the sliding door and extending into the recess to permit longitudinal movement of the mounting member along the longitudinal recess.

8. The filling of claim 7, wherein the transverse recess extends through said longitudinal recess and is shaped correspondingly, the transverse groove having openings adjacent a front face and adjacent a rear face of the door for the lateral positioning of said mounting member.

9. The fitting of claim 8, wherein each of the longitudinal and transverse recesses has a width greater than that of the corresponding longitudinal and transverse grooves to receive a correspondingly shaped part of the head of said mounting member in a substantially form locked fashion and to lock said head against any rotation.

* * * * *